US010987683B1

(12) United States Patent
Marrs

(10) Patent No.: US 10,987,683 B1
(45) Date of Patent: Apr. 27, 2021

(54) LINEAR PUMP APPARATUS FOR DISPENSING LIQUIDS

(71) Applicant: MARSHALL ELECTRIC CORP., Rochester, IN (US)

(72) Inventor: James C. Marrs, Rochester, IN (US)

( * ) Notice: Subject to any disclaimer, the term of this patent is extended or adjusted under 35 U.S.C. 154(b) by 0 days.

(21) Appl. No.: 16/783,873

(22) Filed: Feb. 6, 2020

(51) Int. Cl.
*B05B 7/08* (2006.01)
*B05B 7/04* (2006.01)

(52) U.S. Cl.
CPC ..... *B05B 7/0876* (2013.01); *B05B 7/0408* (2013.01)

(58) Field of Classification Search
CPC ..... B05B 7/0876; B05B 7/0408; B05B 9/042; F04B 43/1215; F04B 43/1223
USPC ..... 222/101, 102, 214
See application file for complete search history.

(56) References Cited

U.S. PATENT DOCUMENTS 2,094,524 A * 9/1937 Busch ..... F04B 45/06 141/59
3,302,832 A * 2/1967 Anderson ..... B05C 17/005 222/94
3,656,518 A 4/1972 Aronson
3,679,331 A * 7/1972 Kushner ..... F04B 43/086 417/478
4,407,431 A 10/1983 Hutter, III
4,777,906 A 10/1988 Mourning
4,880,149 A * 11/1989 Scholefield ..... B01L 3/0296 222/207
5,431,307 A * 7/1995 Brown ..... B05C 11/10 222/135
5,816,445 A 10/1998 Gardos
5,927,560 A 7/1999 Lewis
6,789,700 B1 * 9/2004 Arniotis ..... B65D 35/28 222/105
7,044,340 B1 5/2006 McClellan
7,607,554 B2 * 10/2009 Hynes ..... F04B 43/1223 222/101
7,963,690 B2 6/2011 Thompson
2007/0138202 A1 * 6/2007 Evers ..... B67D 7/0216 222/95
2009/0084816 A1 4/2009 Varga
2013/0056497 A1 * 3/2013 McNulty ..... A47K 5/14 222/190

FOREIGN PATENT DOCUMENTS

WO 2004014534 A3 4/2004

* cited by examiner

*Primary Examiner* — Vishal Pancholi
(74) *Attorney, Agent, or Firm* — Egbert Law Offices, PLLC

(57) ABSTRACT

A liquid dispensing apparatus has a frame, a plurality of tubes supported by the frame, and a roller assembly supported by the frame. The roller assembly is movable between an upper position and a lower position. The roller assembly is cooperative with the plurality of tubes so as to apply compressive force to the plurality of tubes in the upper position and to release the compressive force in the lower position. The roller assembly is movable for a desired distance along the length of the plurality of tubes. The roller assembly is adapted to urge a liquid out of a lower end of the plurality of tubes by applying the compressive force to the plurality of tubes and moving the roller assembly downwardly along the plurality of tubes while the compressive force is applied to the plurality of tubes.

12 Claims, 5 Drawing Sheets

LINEAR PUMP APPARATUS FOR DISPENSING LIQUIDS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the dispensing of liquids. More particularly, the present invention relates to the dispensing of liquids from multiple outlets and in equal amounts from each of the outlets. Furthermore, the present invention relates to the dispensing of mixed multi-part liquids, such as epoxies or polyurethanes.

2. Description of Related Art Including Information Disclosed Under 37 CFR 1.97 and 37 CFR 1.98

In many manufacturing processes, it is desirable to dispense a precise amount of liquid to a variety of objects. In one circumstance, in the manufacturing of ignition coils, it is important to be able to deliver a precise amount of at a liquid, such as potting material into the interior of the ignition coil. In the mass production of ignition coils, it is important to dispense a precise amount of liquid to a large number of ignition coils at the same time.

In the past, various types of pumping apparatus have been used for the dispensing of liquid. Unfortunately, these pumping devices required a great deal of machinery. In the mass production of ignition coils, separate pumping devices would be required for each ignition coil. Under certain circumstances, these pumping devices failed to deliver the precise amount of potting material to the ignition coil housing. In other circumstances, these pumping devices would not operate simultaneously. As such, it would not be adaptable for a mass production process in which the potted ignition coils are moved, as a group, to a different location for curing and other processing.

The problems associated with the dispensing of equal quantities of liquid through multiple outlets simultaneously is particularly compounded when multi-component curable compositions are the liquid. Prior art dispensing systems for these multi-component curable compositions typically included appropriate pumping mechanisms for pumping and metering separate materials, such as a base material and an accelerator material, in a prescribed ratio to a mixing device where the materials are thoroughly mixed together. When mixed, the two materials interact with each other to create a flowable, curable composition which will set up or harden in a non-flowable state in a relatively short period of time, referred to frequently as the "cure" time. Examples of such compositions are polymerizable resins and the like wherein the base material comprises a substance including unreacted polymers such as a polysulfide resin together with diluting solvents such as toluene for viscosity control, and wherein the accelerator material comprises a polymerization initiator such as an appropriate oxidizer which provides the desired chemical reaction when mixed with the base material. Various other chemical components and combinations of components may be included to either the base material or the accelerator material to adjust resultant physical properties of the mixed composition, and environmental parameters such as temperature can be controlled to increase or decrease the cure time, as desired. In any event, the mixed composition must be supplied promptly from the mixing device to an appropriate dispensing nozzle for application to a surface before the composition cures.

Curable compositions of the general type described hereinabove are used, for example, as adhesives or sealants in a wide variety of industrial applications. The mixed composition is applied from the dispensing system through the dispensing nozzle directly to the surface or point of application where the composition is desired. In common assembly line type operation, the flow of the mixed composition is necessarily required to be intermittent since the composition is applied to production items in sequence passing along the assembly line, in order to prevent substantial waste of the composition as the dispensing nozzle is moved from one production item to another.

Prior two-part fluid dispensers of this type have inherently operated with dispensing problems and limitations, including requirements for expensive bulk meter mix dispensing apparatus that demand costly cleanup and maintenance procedures and involve operator exposure to toxins in the fluids. The conventional two-part fluid cartridge dispenser systems lacks sufficient accuracy for controlled applications. In addition, such cartridge systems are subject to cartridge and/or piston deformation in use; and, with their monitoring of the air volume required to dispense, have shot size affected by variation in air pressure, fluid viscosities and humidity, among other factors. They are not adapted, furthermore, for two-part fluids having widely different viscosities and for widely variable ratio mixing and dispensing cartridge arrays. Prior apparatus of this type, moreover, are frequently subject to lead/lag, oozing, drooling or dripping difficulties that cause users often to continue with manual mixing and dispensing operations despite their poor reliability, high labor costs, waste, and personnel exposure to materials and solvents.

In the dispensing of minute, precise quantities of liquids, such as the dispensing of epoxy to encapsulate portions of integrated circuits, it is important to achieve and maintain high repeatability in the dispensing quantity, notwithstanding possible variations in the temperature and/or viscosity of the liquid. For some applications, the liquid dispensed is extremely sensitive to such changes. For example, in encapsulating integrated circuits, it is difficult to use a two component epoxy which is premixed by the epoxy manufacturer and then frozen. The epoxy must then be used within a few days, and in some instances within a few hours.

For typical dispensing systems, an epoxy for encapsulating will have a relatively high viscosity. However, as the temperature changes, the viscosity is also subject to change. These viscosity variations can affect dispensing volumes, particularly of a positive volume displacement device as used to dispense the epoxy. For a given set of dispensing stroke parameters, i.e. displacement distance, force and rate, the dispensing result will vary with variations in viscosity.

Another problem relates to air or bubble entrapment within the liquid to be pumped from the pumping device. Obviously, if a displacement pump is compressing entrapped air during the displacement stroke, the relationship between the displacement stroke and the dispensed volume will become distorted.

Many of the premixed two-part proxies used for encapsulations of this type contain an abrasive fill material, such as silica. This abrasive fill material can cause undue wear on to the dispensing apparatus, again adversely affecting the dispensing and/or resulting excessive downtime due to the need for repair or replacement of worn components.

While auger pumps have been used in the past to perform precise quantity dispensing of this type, the output of a typical auger pump varies directly with variations in the viscosity of the dispensed fluid, the needle size and the supply pressure. While the effect of viscosity changes and the fluid flow rate can be minimized with proper pump design, advanced calibration techniques and manual adjustments of the valve operation are required. Thus, the maximum possible mass flow rate while maintaining accuracy is limited.

In the past, various patents and patent application publications have issued with respect to various liquid dispensing apparatus and, in particular, for the dispensing of multi-part liquids. For example, U.S. Pat. No. 3,656,518, issued on Apr. 18, 1972 to T. F. Aronson, discloses a method and apparatus for measuring and dispensing predetermined equal amounts of powdered material. This apparatus has a measuring chamber having a piston movably mounted therein for movement between a retracted loading position and a protracted discharging position. The head of the piston is formed of a porous material which is pervious to a gaseous medium, but impervious to the powder to be measured and dispensed. Charging of the measuring chamber with a measured amount of powdered material is attained by drawing a vacuum on the chamber when the piston is displaced to a retracted loading position. Dispensing of the measured powder charge from the measuring chamber is attained by effecting displacement of the piston toward a protracted discharging position to push the measured charge of powder in front of the piston out of the measuring chamber. Positive separation of the measured charge from the end of the piston head is attained by applying a force of positive fluid pressure on the end of the piston head in the protracted position to discharge the powder charge therefrom.

U.S. Pat. No. 4,407,431, issued on Oct. 4, 1983 to C. G. Hutter, discloses a system for dispensing curable compositions. The curable compositions are formed by mixing first and second materials which, when mixed in a prescribed ratio, interact with each other to provide a relatively rapidly curable composition, such a polymerizable epoxy resin or the like. The materials are individually pumped and metered through a first mixer and a dispensing valve to a dispensing nozzle. During start-up, the dispensing nozzle is closed, and the initial mixed composition is diverted through a bypass valve for dilution and mixture with a diluent stream of the first material and a second mixture and for return of the diluted mixture to the supply reservoir of the first material. When a homogenous mixture of the prescribed ratio is achieved at the outlet of the first mixer, the bypass valve is closed and the dispensing valve can be opened to allow dispensing of the composition. Upon shut-down, supplying the second material to the first mixer is ceased, and the dispensing valve and bypass valve are closed and opened, respectively. The first material is supplied to the first mixer and through the bypass valve to flush the composition therefrom and for dilution of the composition with the diluent stream in the second mixer.

U.S. Pat. No. 4,777,906, issued on Oct. 18, 1988 to Mourning et al., shows an apparatus for mixing and dispensing an epoxy adhesive. The epoxy resin and its associated curing agent are simultaneously loaded from separate cartridges into a length of flexible PVC tubing, part of which is contained between a rotor and a stator. Bearings, mounted rotatably about the rotor, engage in travel along the tubing as the rotor is revolved, each bearing compressing the tubing at its point of engagement. The tubing, repeatedly compressed and released by each varying in succession, kneads the epoxy resin and curing agent into a homogenous mixture. From the tubing, the epoxy mixture is deposited on a moving carrier tape and forms a continuous bead. Downstream, a control tape is spaced apart from the carrier tape and moves in the opposite direction. As the bead encounters the control tape, the control tape removed as part of the bead material from the carrier tape and plastically forms the remaining mixture into a film of uniform thickness substantially less than the bead diameter.

U.S. Pat. No. 5,816,445, issued on Oct. 6, 1998 to Gardos et al., teaches a method and apparatus for the controlled dispensing of two-part bonding, casting and similar fluids. The two-part fluids are forced out of their respective cartridges in response to variable air pressure into a static mixture. The mixed materials are then provided along a dispensing flexible pinch tube. The opening and closing of which is controlled by a pinch valve operated in response to either a manual or microprocessor-controlled device.

U.S. Pat. No. 5,927,560, issued on Jul. 27, 1999 to Lewis et al., shows a dispensing pump for epoxy encapsulation of integrated circuits. This dispensing pump includes a pumping chamber in communication with a nozzle via a three-way valve. The pumping chamber has an outlet, an internal volume, a pair of spaced directional seals located away from the outlet, an open volume residing between the seals and an external port opening the open volume to atmosphere. A stepped plunger extends axially within the pumping chamber. The step plunger has a first portion sized to be received in a line through the first directional seal. The plunger is movable to move the first portion toward the outlet to close off the internal volume at the second seal. The second portion of the plunger is relatively smaller in transverse cross-sectional dimension than the inside diameter of the second seal in order to cooperate with the port to promote fluid removal from the internal volume during initial filling and priming of the pumping chamber. Once filled and primed, the plunger causes positive volume displacement of the liquid from the pumping chamber and out of the nozzle.

U.S. Pat. No. 7,044,340, issued on May 16, 2006 to L. W. McClellan, describes an apparatus and method for mixing and injecting or applying a viscous material and is particularly useful for mixing and applying a two part epoxy. The apparatus utilizes two uniformly heated holding tanks with auger feeds which each feed two synchronized variable ratio pumps having spring-biased check valves which ensure positive closure of each valve. The apparatus further has a dispensing and mixing head which is fed from the synchronized pumps and serves to uniformly mix the viscous material and dispense the material as a blend.

U.S. Pat. No. 7,963,690, issued on Jun. 21, 2011 to Thompson et al., teaches a dispenser with a dynamic mixer for two-part compositions. The dispenser has a manifold for individually channeling each of the components of the multi-part curable composition into a disposable and flexible retraction tube. The disposable and flexible retraction tube allows the components of the curable composition to be brought into contact with each other. A mixer acts upon the walls of the reaction tube in such a way as to facilitate or directly affect the intermixing of the components of the curable composition. The disposable and flexible reaction tube extends from the manifold through the mixer and ends with an orifice through which the curable composition is expelled or dispensed.

U.S. Patent Application Publication No. 2009/0084816, published on Apr. 2, 2009 to L. J. Varga, provides a liquid metering device for pumping two components of an adhesive into a mixer. This liquid metering system utilizes gear pumps of certain dimensions to pump each component into a manifold which delivers the components to a mixer where the components become an adhesive. A fixed mass flow ratio related to the size of the gear pumps is automatically established because the gear pumps are driven by the same motor at a fixed speed ratio.

International Publication No. WO 2004/014534 published on Feb. 19, 2004 to K. W. V. Baier, discloses a tubular mixer for mixing pasty materials or liquids consisting of at least two components. This tubular mixer comprises a tube which is arranged in a vertical position in a housing. The tube is made of a flexible intrinsically resistant material which has an upper inlet for the components to be mixed and a lower outlet for the mixture. The tube is pressed together or squeezed from an outward direction by press rollers or cylinders which are driven peripherally and pressed against the wall of the tube by an elastic force and also driven peripherally about the longitudinal axis thereof by means of the press rollers or cylinders. Alternatively, the tube can be pressed together or squeezed from an outward direction by free-floating press rollers or cylinders which are pressed against the wall of the tube by an elastic force. The tube is driven peripherally about the longitudinal axis thereof such that a mixing gap is formed in a longitudinal direction of the tube in the respective narrowest part of the tube. The components of the liquid are mixed as a result of the friction thus arising and the adhesion associated therewith on the inner wall of the tube.

It is an object of the present invention provide a dispenser apparatus that dispenses equal amounts of a liquid from multiple outlets simultaneously.

It is another object of the present invention to provide a dispenser apparatus that utilizes disposable tubing.

It is another object of the present invention to provide a dispenser apparatus that reduces the time required for cleaning.

It is a further object of the present invention to provide a dispenser apparatus that is reliable and repeatable.

It is another object of the present invention to provide a dispenser apparatus that has a relatively low cost.

It is still another object of the present invention to provide a dispenser apparatus that allows the operator to easily set the desired amount of the liquid to be dispensed.

It is another object of the present invention to provide a dispenser apparatus which allows for the proper dispensing of mixed multi-part liquids.

These and other objects and advantages of the present invention will become apparent from a reading of the attached specification and appended claims.

BRIEF SUMMARY OF THE INVENTION

The present invention is a liquid dispensing apparatus that comprises a frame, a plurality of tubes supported by the frame, and a roller assembly supported by the frame. Each of the plurality of tube is flexible. The roller assembly is movable between an upper position and a lower position. The roller assembly is cooperative with the plurality of tubes so as to apply compressive force to the plurality of tubes in the upper position and release the compressive force on the plurality of tubes in the lower position. The roller assembly is movable for a desired distance along the length of the plurality of tubes. The roller assembly is adapted to urge a liquid out of the lower end of the plurality of tubes by applying the compressive force to the plurality of tubes and moving the roller assembly downwardly along the plurality of tubes while the compressive force is applied to the plurality of tubes.

A valve assembly is cooperative with the plurality of tubes adjacent to the lower end of the plurality of tubes. The valve assembly has a first position closing the plurality of tubes and a second position opening the plurality of tubes. The valve assembly is in the first position after the roller assembly has moved downwardly for the desired distance and while the roller assembly moves to the upper position. The valve assembly is in the second position while the roller assembly moves for the desired distance downwardly along the length of the plurality of tubes. In the preferred embodiment of the present invention, the valve assembly comprises a plurality of pinch valves respectively affixed to the plurality of tubes.

The roller assembly comprises a plurality of roller assemblies respectively cooperative with the plurality of tubes. Each of the plurality of roller assemblies comprises a housing, a first roller on one side of a tube of the plurality of tubes, a second roller on an opposite side of the tube of the plurality of tubes, and an actuator cooperative with at least one of the first and second rollers. The actuator moves the first and second rollers relative to each other so as to move toward each other so as to apply the compressive force to the tube and move away from each other so as to release the compressive force from the tube. A panel supports the plurality of roller assemblies in an identical position with respect to the plurality of tubes such that each of the plurality of roller assemblies is in an identical relative position as the roller assembly moves along the plurality of tubes. A linear bearing is connected to the roller assembly. The linear bearing is connected to the roller assembly so as to move the roller assembly upwardly and downwardly for the desired distance. The linear bearing is specifically a double-acting pneumatic actuator affixed to the frame. This double-acting pneumatic actuator extends in generally parallel relationship to the plurality of tubes.

Each of the plurality of tubes is a flexible plastic tube having an upper end and a lower end supported by the frame. The plurality of tubes has a lower end extending outwardly of the bottom of the frame. A plurality of nipples can be respectively affixed to the lower end of the each of the plurality of tubes. The plurality of nipples is adapted to allow the liquid to be released therefrom and to be directed downwardly.

In the present invention, a manifold is connected to an upper end of the plurality of tubes. The manifold is adapted to supply the liquid to the plurality of tubes. The present invention further comprises a supply of the liquid, a conduit extending from the supply of the liquid to the manifold, and a pump cooperative with the supply of the liquid so as to urge the liquid through the conduit and into the manifold. In the preferred embodiment the present invention, the liquid is a multi-part fluid. The supply of the liquid further comprises a first container containing one part of the multi-part fluid and a second container containing another part of the multi-part fluid. A static mixer is connected to the conduit so as to receive the parts of the multi-part fluid from the first and second containers and to mix the parts together. The conduit extends from the static mixer to the manifold. In the preferred embodiment the present invention, the liquid is an epoxy or a polyurethane material.

The present invention is also a process for dispensing a liquid. This process includes the steps of: (1) forming a plurality of tubes extending in a vertical orientation; (2) connecting the upper end of the plurality of tubes to a supply of the liquid; (3) compressing a pair of rollers against an outer surface of each of the plurality of tubes so as to squeeze each of the plurality of tubes; (4) moving the compressed pair of rollers along each of the plurality of tubes for a desired distance along a length of the tube so as to urge the liquid out of a lower end of the plurality of tubes; (5) releasing the compressed pair of rollers from each of the plurality of tubes; and (6) returning the released pair of rollers upwardly along each of the plurality of tube so as to return the pair of rollers to an upper position.

In the method of the present invention, the step of compressing and moving occur simultaneously with respect to the plurality of tubes. A valve is opened adjacent to a lower end of each of the plurality of tubes prior to the step of moving. The valve is closed prior to the step of returning. The step of connecting comprises connecting the upper end of each of the plurality of tubes to a manifold. The manifold has the supply of liquid therein. In the preferred embodiment of the present invention, the liquid is a multi-part epoxy or polyurethane. The parts of the multi-part epoxy or polyurethane are mixed prior to passing the liquid to the manifold.

This foregoing Section is intended to describe, with particularity, the preferred embodiments of the present invention. It is understood that modifications to the preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
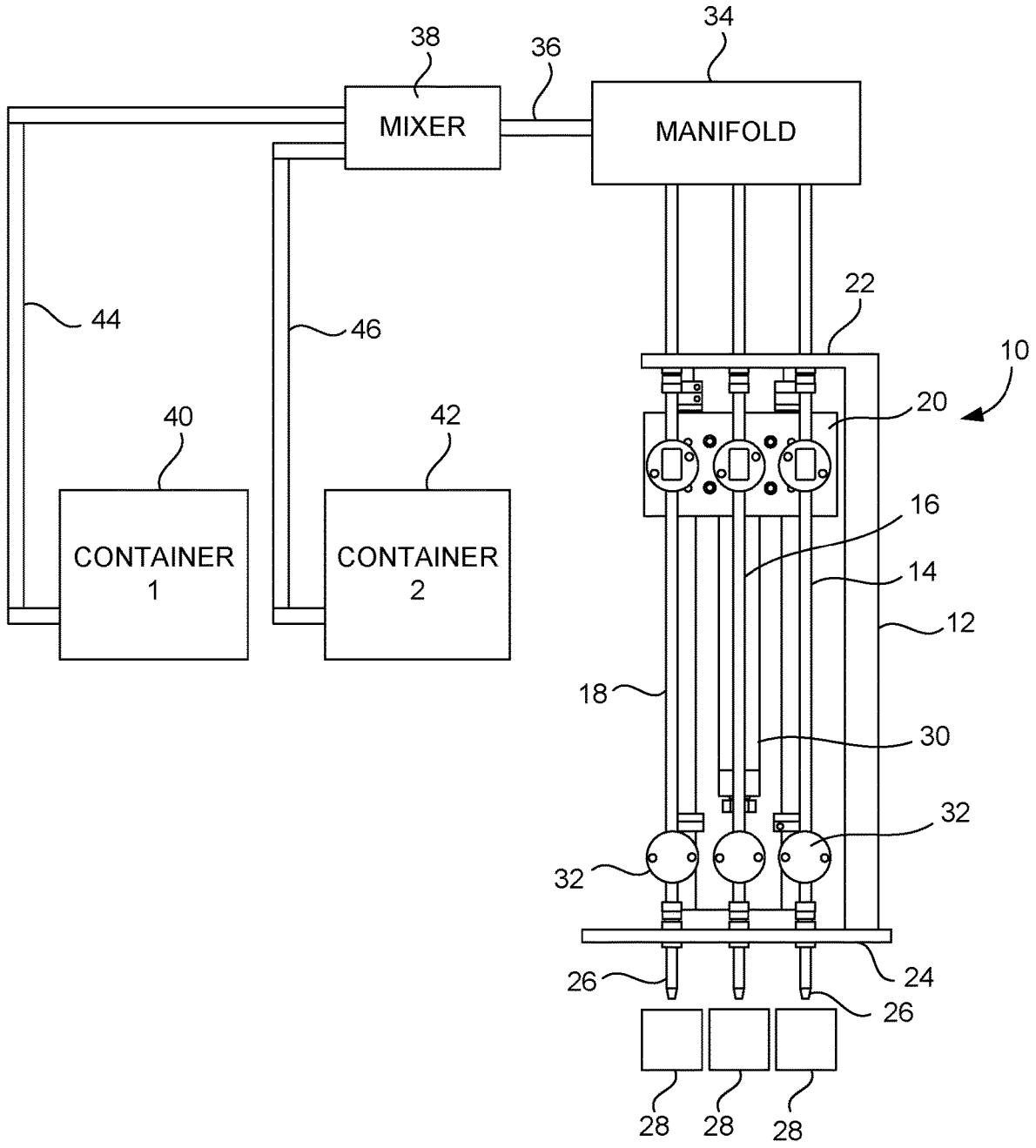
FIG. 1 is a diagrammatic illustration of the dispenser apparatus in accordance with the preferred embodiment of the present invention.

Referring to FIG. 1, there is shown the liquid dispenser apparatus 10 in accordance with the present invention. The liquid dispenser apparatus 10 has a frame 12, a plurality of tubes 14, 16 and 18, and a roller assembly 20. The plurality of tubes 14, 16 and 18 are supported by the upper portion 22 and the lower portion 24 of frame 12. The roller assembly 20 is shown in an upper position.

Each of the plurality of tubes 14, 16 and 18 is formed of a flexible and compressible plastic material. As such, each of the plurality of tubes 14, 16 and 18 is replaceable. This is important since the liquid accumulates and solidifies on the inner walls of each of the plurality tubes 14, 16 and 18. The inexpensive plastic tubes can easily be replaced. Cleaning is not required. The replacement of each of the tubes 14, 16 and 18 can be carried out in a relatively easy manner by threading the upper portion of each of the tubes 14, 16 and 18 through an opening in the upper portion 22 of frame 12 and threading the lower end of each of the plurality of tubes 14, 16 and 18 through respective holes in the bottom portion 24 of frame 12. Nipples 26 can be applied to the lower end of each of the plurality of tubes 14, 16 and 18. Nipples 26 assure that the liquid dispensed from each of the tubes 14, 16 and 18 is directly delivered into the interior of objects 28 that are intended to receive the liquid. In the preferred embodiment the present invention, each of the objects 28 can be an ignition coil housing. As such, the liquid that is dispensed would be a potting material, such as an epoxy. However, it should be noted that the present invention can be used for a wide variety of other objects which are intended to receive the liquid therein.

It is important to note that only three tubes 14, 16 and 18 are shown in FIG. 1. The present invention is adaptable to allow a large number of tubes to be employed. Depending on the requirements of the mass production process, the number of tubes can be adapted to the number of objects 28 to which the material is to be supplied. As such, if there are twenty objects that require the liquid dispensed from the dispenser apparatus 10, then twenty tubes can be employed in an extended array. When the roller assembly 20 is moved downwardly along each of the plurality of tubes 14, 16 and 18, an identical and simultaneous delivery of the liquid to the objects 28 occurs. The amount of liquid to be delivered will be dependent upon the interior diameter and volume of each of the tubes 14, 16 and 18 and the distance of the stroke of the roller assembly 20 along each of the tubes. Since the inner diameter of the of each of the tubes is readily ascertained, simple calculations will determine the amount of liquid that is dispensed from a single stroke of the roller assembly 20. As such, the present invention delivers an equal amount of liquid to each of the objects 28 simultaneously.

FIG. 1 shows that there is an actuating cylinder 30 that is affixed to the frame 12. Actuating cylinder 30, as will be described hereinafter, is connected to the roller assembly 20 so as to move the roller assembly 20 upwardly and downwardly for a desired stroke. Pinch valves 32 are affixed adjacent to the lower end of each of the tubes 14, 16 and 18. These pinch valves 32, as will be described hereinafter, operate to open or close the lower end of each of the tubes 14, 16 and 18.

The upper end of each of the tubes 14, 16 and 18 is connected to a manifold 34. Manifold 34 is connected by conduit 36 to a static mixer 38. The static mixer 38 is employed so as to mix the components of a multi-part fluid. One part of the multi-part liquid is contained in fluid supply 40. Another part of the multi-part liquid is supplied from the fluid to the liquid supply 42. Each of the liquid supplies 40 and 42 is in a container or drum. A conduit 44 supplies the liquid from the container 40 to the static mixer 38. Conduit 46 delivers the liquid from the container 42 to the mixer 38. Suitable pumps can be connected to the containers 40 and 42 or along the conduits 44 and 46 so as to deliver the components of the liquid to the mixer in the desired ratios. Ultimately, after mixing, the liquid is delivered along conduit 36 under pressure into the manifold 34. Since the parts of a multi-part liquid are mixed in their proper ratios and that delivered to the manifold 34, the liquid will be in a desired proportion for delivery into each of the tubes 14, 16 and 18. As such, the liquid in each of the tubes 14, 16 and 18 will be of identical proportions.

Figure 2:
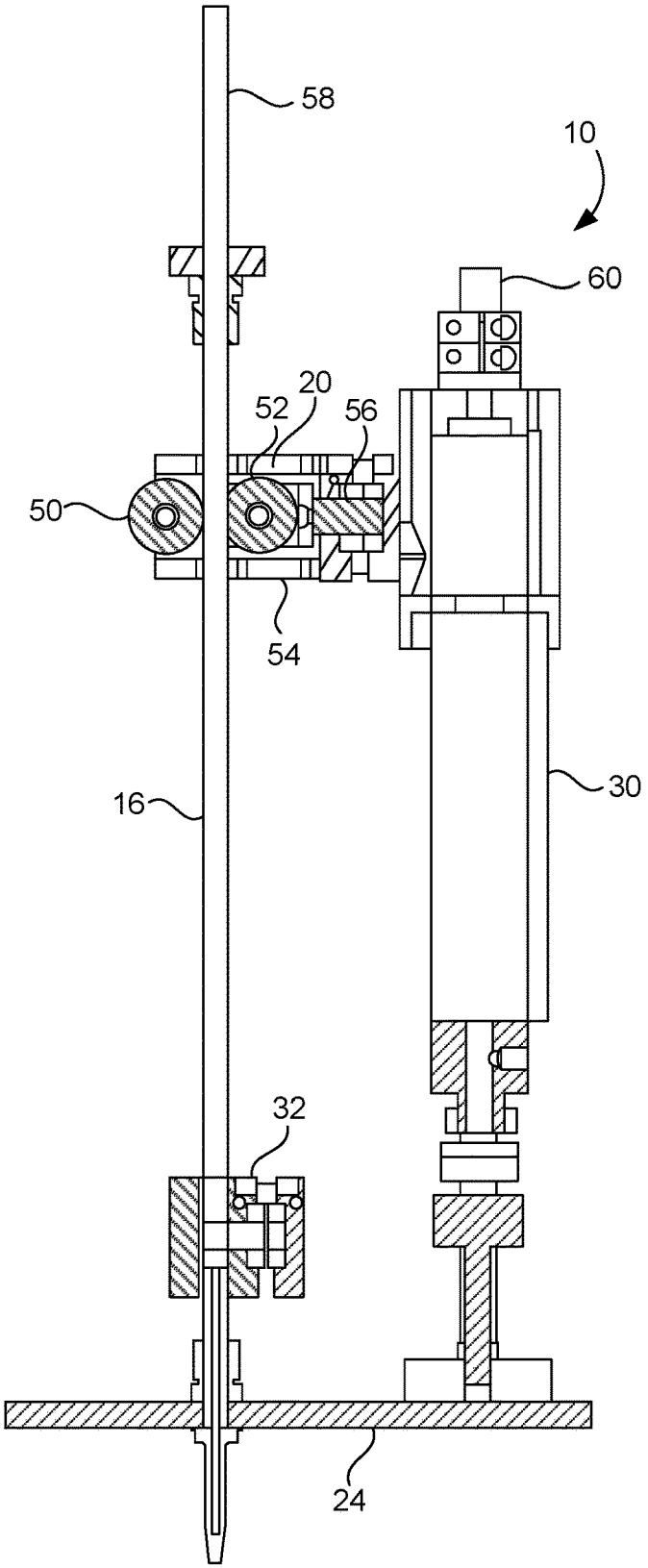
FIG. 2 is a cross-sectional side view of the dispenser apparatus of the present invention with the roller assembly in an upper position.

FIG. 2 shows the liquid dispenser apparatus 10 with the roller assembly 20 in an upper position along the tube 16. Each of the tubes 16 will have an identical configuration. FIG. 2 shows that the roller assembly 20 has a first roller 50 and a second roller 52 within a housing 54. An actuator 56 is configured so as to urge one of the rollers 50 and 52 toward or away from each other. In particular, the actuator 56 is illustrated as acting on the second roller 52. However, other configurations can be envisioned, such as the actuator 56 acting on the first roller 50 or acting on both of the rollers. The actuator 56 can be in the nature of a double-acting pneumatic cylinder. When the rollers 50 and 52 are moved relatively toward each other, they will act so as to compress the tube 16 and to squeeze the tube. The pinch valve 32 is illustrated as supported a distance above the bottom portion 24 of the frame 12. The pinch valve 32 will act on the tube 16 so as to open or close the tube. FIG. 2 shows that the pinch valve 32 has acted so as to close the lower end of the tube 16.

In FIG. 2, the liquid will be supplied from the manifold 34 into the upper end 58 of tube 16. This flow will continue downwardly through the tube 58 until the tube is filled. This flow will continue into upper end 58 and ultimately stop at the pinch valve 32. The actuator 56 is then in a position to move the rollers 50 and 52 relative to each other so as to squeeze the tube 16. The linear bearing 30 (or actuator) is illustrated in FIG. 2 as supporting the roller assembly 20 in its upper position. The linear bearing 30 is also mounted on the frame 12 and supported by the bottom portion 24 of the frame 12. The linear bearing 32 is a double-acting pneumatic actuator. As such, as air is introduced into the inlet 60, the housing 56 will be moved downwardly by the linear bearing 30.

Figure 3:
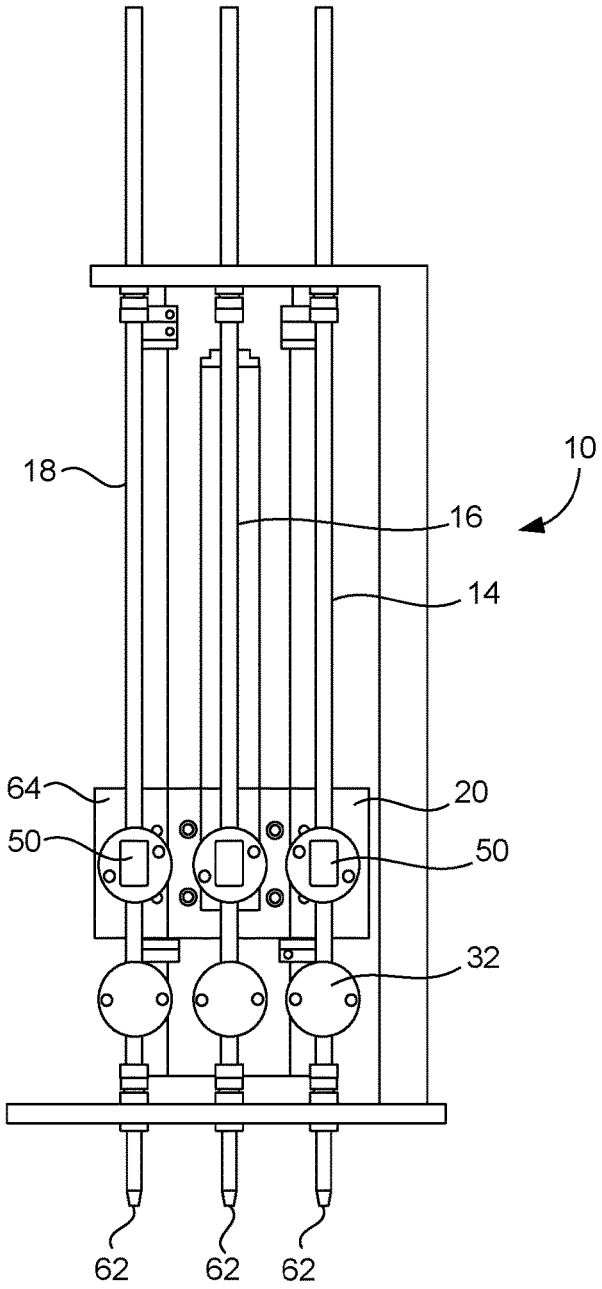
FIG. 3 is a frontal view of the dispenser apparatus of the present invention with the roller assembly in a lower position.

FIG. 3 shows the dispenser apparatus 10 of the present invention with the roller assembly 20 in a lower position. In this position, liquid will be dispensed outwardly from the outlets 62 of each of the tubes 14, 16 and 18. During the dispensing of the liquids, the pinch valves 32 will be open.

FIG. 3 shows the roller assembly 20 as having the first roller 50 exposed on the outer side of the panel 64. Panel 64 supports each of the roller assemblies in a desired position with respect to the tubes 14, 16 and 18. As such, panel 64 assures that each of the roller assemblies therein will move simultaneously in an identical relative position relative to the tubes 14, 16 and 18.

Figure 4:
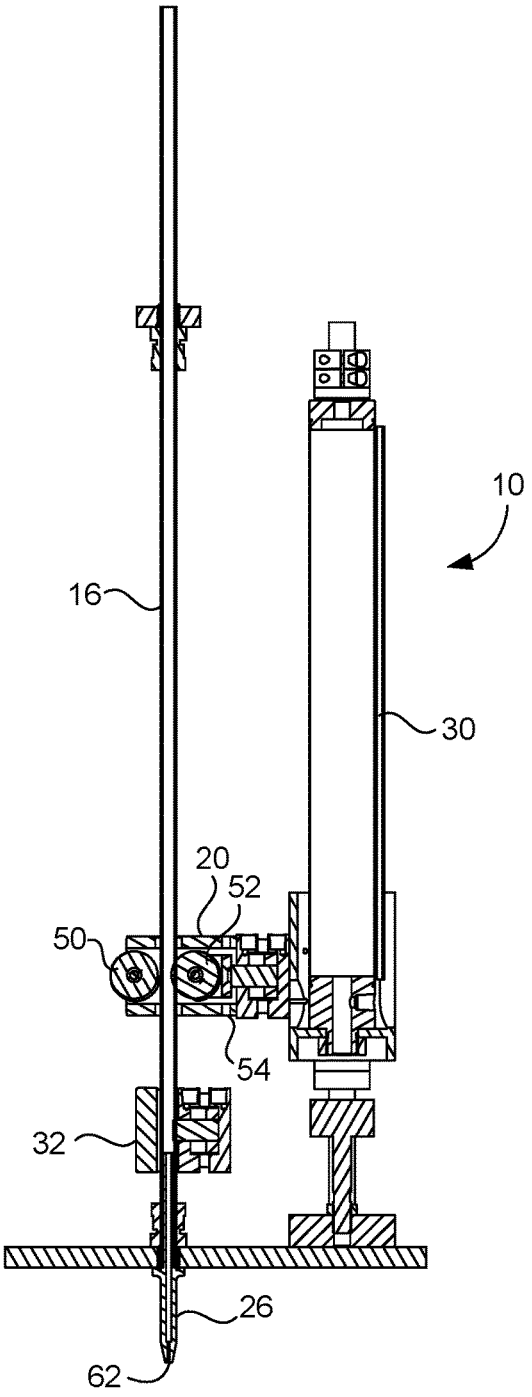
FIG. 4 is a cross-sectional side view of the dispenser apparatus the present invention with the roller assembly in a lower position.

FIG. 4 shows a side view of the liquid dispenser apparatus 10 with the roller assembly 20 in a lower position. The pinch valve 32 is open so as to allow for the liquid within the interior of the tube 16 to be dispensed therefrom. The linear bearing 30 is shown at the desired lowest portion of its stroke. As such, the housing 54 of the roller assembly 20 will be at its desired lower position. The linear bearing 30 is a double-acting pneumatic actuator in which the stroke thereof can be easily set by adjusting the amount of air introduced into the interior of the linear bearing 30. During the course of the stroke of the linear bearing 30, the rollers 50 and 52 compress the tube 16 so as to urge the liquid in the tube downwardly through the pinch valve 32 and outwardly of the lower outlet 62 of the nipple 26 at the end of the tube 16. The actuator 56 (acting on one of the rollers 50 and 52) will cause the rollers 50 and 52 to separate from each other and to leave the tube 16 in an uncompressed condition. As such, the linear bearing 36 is now in a proper configuration so as to move the housing 54 back upwardly along the length of the tube 16.

Figure 5:
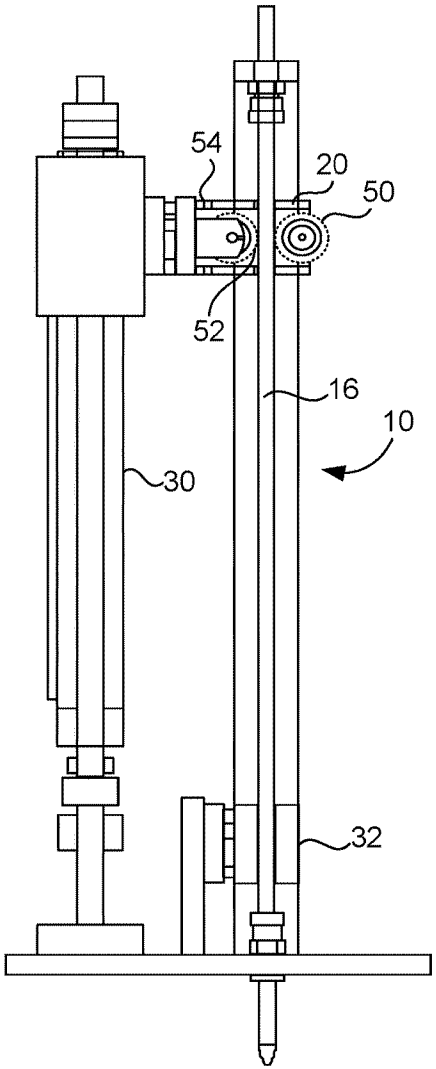
FIG. 5 is a side elevational view of an initial step of the dispensing process of the present invention.

FIG. 5 shows the liquid dispensing apparatus 10 of the present invention with the roller assembly 20 in its uppermost position. The pinch valve 32 is in an open configuration. The linear bearing 30 supports the housing 54 of the roller assembly 20 and its upper position along the length of the tube 16. The rollers 50 and 52 are illustrated as compressing the tube 16.

Figure 6:
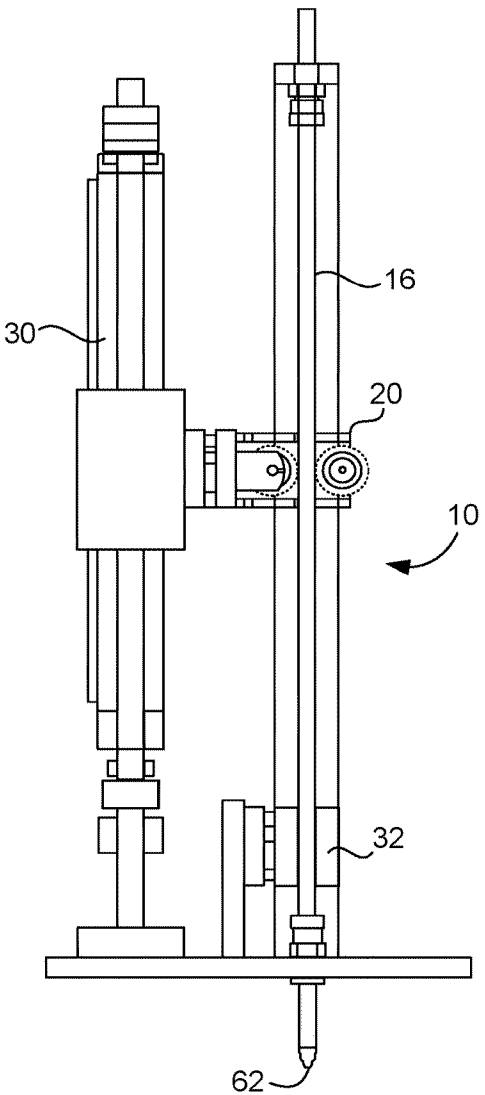
FIG. 6 is a side elevational view showing an intermediate step of the dispensing process of the present invention.

FIG. 6 shows that the linear bearing 30 has moved the roller assembly 20 downwardly along the tube 16 so as to compress the tube. As such, FIG. 6 shows the liquid dispenser apparatus 10 in an intermediate position. The pinch valve 32 is opened. As such, liquid will be dispensed from the tube 16 through the outlet 62. The amount of liquid that is dispensed at this point in time will be the amount of liquid in the tube 16 between the position of the roller assembly 20 (is shown in FIG. 5) and the intermediate position (as shown in FIG. 6). It is important to note that the movement of the roller assembly 20 in this compressed configuration will create a vacuum which serves to draw liquid from the manifold 34 back into each of the tubes in generally a trailing relationship to the movement of the roller assembly 20.

Figure 7:
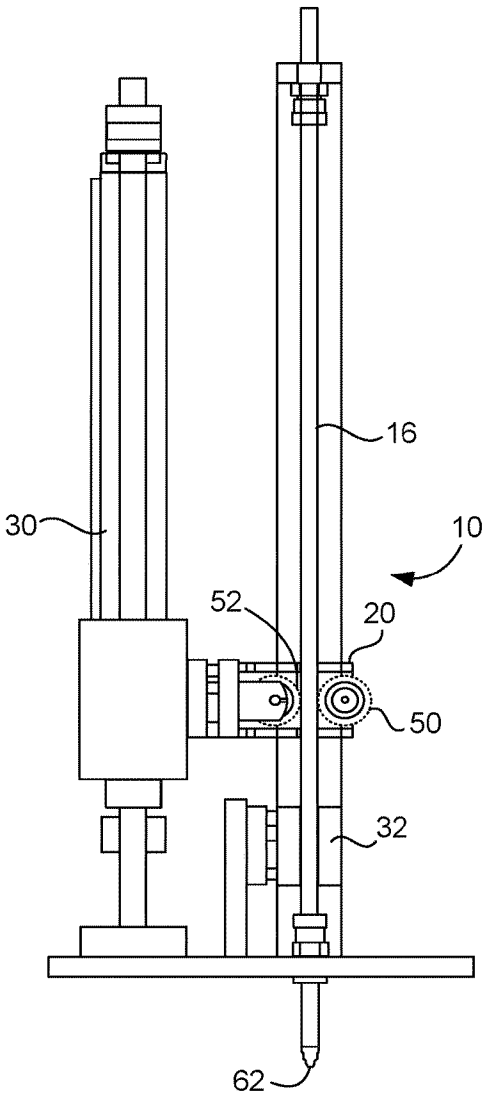
FIG. 7 is a side elevational view showing a further study the further step in the dispensing process of the present invention.

FIG. 7 shows the liquid dispenser apparatus 10 with the roller assembly 20 in its desired and fixed lower position. In this lower position, the liquid in tube 16 has been fully dispensed outwardly of the outlet 62. After the dispensing has occurred, the pinch valve 32 is suitably closed, and the rollers 52 and 50 are moved away from each other so that the tube 16 is no longer compressed. The linear bearing 30 can then move back to the upper position (as shown in FIG. 5). Since the vacuum created by the movement of the roller assembly 20 has drawn fluid from the manifold into the tube 16, the return of the roller assembly 20 back to the upper position (such as shown in FIG. 5) will assure that the tube 16 is properly loaded with a new supply of fluid. The pinch valve 32, in its closed position, will prevent any leaking or oozing of the fluid column between the pinch valve 32 and the outlet 62.

Figure 8:
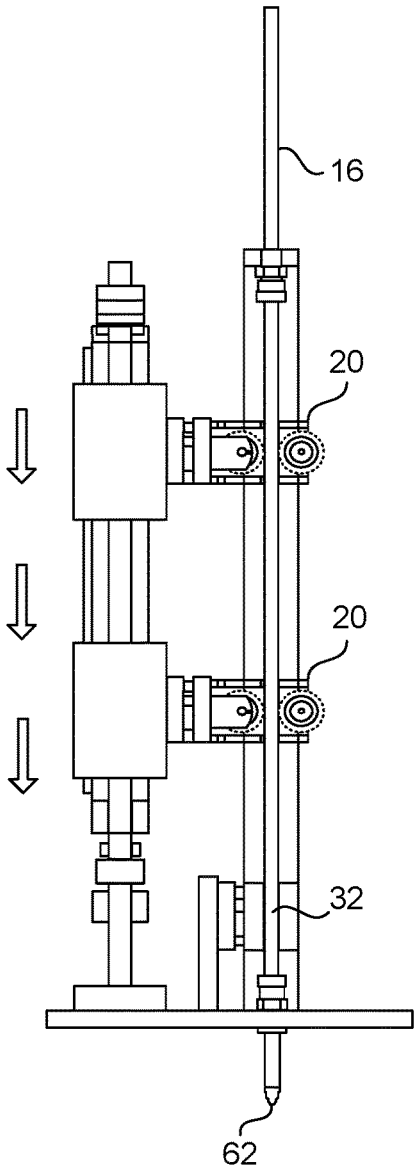
FIG. 8 is a side elevational view showing the manner in which the roller assembly moves downwardly along the tube in order to dispense the liquid therefrom.

FIG. 8 is a further illustration showing the movement of the roller assembly 20 along the tube 16. FIG. 8 shows that the roller assembly 20 has an upper position and a lower position for the dispensing of liquid. During the movement shown in FIG. 8, the rollers from the roller assembly 20 squeeze on the tube 16 so as to urge the liquid in the tube 16 to be dispensed outwardly of the outlet 62. The pinch valve 32 is illustrated as open so as to allow the liquid to flow therethrough.

Figure 9:
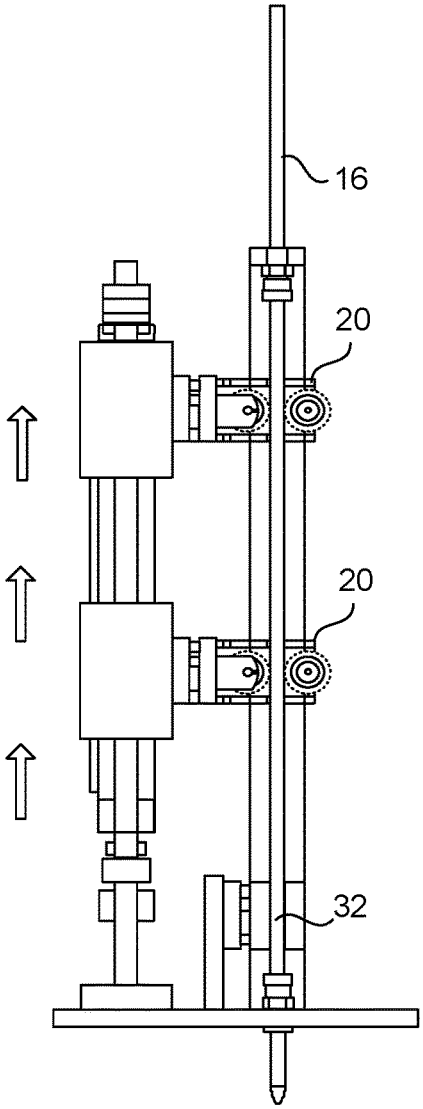
FIG. 9 is a side elevational view showing the steps with which the roller assembly is moved from the lower position upwardly to an upper position.

FIG. 9 shows the upward movement of the roller assembly 20 in the process of the present invention. During this upward movement, the pinch valve 32 is suitably closed and the rollers in each of the roller assemblies 20 are separated from each other so as to not compress the tube 16.

The present invention is particularly related to the dispensing of liquid in a mass production process. In many components and industrial processes, a liquid in measured in equal amounts needs to be dispense simultaneously in a particular step of the production process. The present invention assures that this equal amount of liquid is dispensed simultaneously. In particular, under those circumstances where a multi-part liquid is to be dispensed, the present invention allows the multiple parts of the multi-part liquid to be mixed and then delivered into a manifold. The present invention thereby delivers this mixed multi-part liquid outwardly in a suitably measured equal amount simultaneously into the particular components. After the liquid is dispensed from the liquid dispenser apparatus 10, the filled components can then be moved to another step of the production process. The present invention causes the roller assembly to be returned up to the upper position so that a new set of parts can be positioned for the purpose of being filled with the liquid. The tubes 14, 16 and 18 are made of a relatively inexpensive flexible plastic material. As such, these tubes can be replaced easily on an as-needed basis. In the preferred embodiment the present invention, the tubes are replaced after each day of production. For the purposes of replacing the tubes, it is only necessary to thread the tubes through the suitable openings in the upper and lower portions of the frame and then the thread the tube through the roller assembly and through the pinch valve. The upper end of the tube can then be connected to the suitable outlet of the manifold. The tubes will need to be primed by the proper movement of the roller assembly. After priming, the present invention is ready for production.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A liquid dispensing apparatus comprising:

a frame;

a plurality of tubes supported by said frame, each of said plurality of tubes being flexible;

a roller assembly supported by said frame, said roller assembly movable between an upper position and a lower position, said roller assembly cooperative with said plurality of tubes so as to apply compressive force to said plurality of tubes in the upper position and to release the compressive force in the lower position, said roller assembly being movable for a desired distance along a length of said plurality of tubes, said roller assembly adapted to urge a liquid out of a lower end of said plurality of tubes by applying the compressive force to the plurality of tubes at the upper position and moving the roller assembly downwardly along said plurality of tubes while the compressive force is applied to said plurality of tubes; and a manifold connected to an upper end of said plurality of tubes, said manifold adapted to supply the liquid to said plurality of tubes.

2. A liquid dispensing apparatus comprising:

a frame;

a plurality of tubes supported by said frame, each of said plurality of tubes being flexible;

a roller assembly supported by said frame, said roller assembly movable between an upper position and a lower position, said roller assembly cooperative with said plurality of tubes so as to apply compressive force to said plurality of tubes in the upper position and to release the compressive force in the lower position, said roller assembly being movable for a desired distance along a length of said plurality of tubes, said roller assembly adapted to urge a liquid out of a lower end of said plurality of tubes by applying the compressive force to the plurality of tubes at the upper position and moving the roller assembly downwardly along said plurality of tubes while the compressive force is applied to said plurality of tubes, said valve assembly being in the first position after said roller assembly has moved downwardly for the desired distance and while said roller assembly moves to an upper position, said valve assembly being in the second position while said roller assembly moves for the desired distance downwardly along the length of said plurality of tubes, said valve assembly comprising a plurality of pinch valves respectively affixed to said plurality of tubes;

a valve assembly cooperative with said plurality of tubes adjacent to the lower end of said plurality of tubes, said valve assembly having a first position closing said plurality of tubes and a second position opening said plurality of tubes, said valve assembly being in the first position after said roller assembly has moved downwardly for the desired distance and while said roller assembly moves to an upper position, said valve assembly being in the second position while said roller assembly moves for the desired distance downwardly along the length of said plurality of tubes, said valve assembly comprising a plurality of pinch valves respectively affixed to said plurality of tubes.

3. A liquid dispensing apparatus comprising:

a frame;

a plurality of tubes supported by said frame, each of said plurality of tubes being flexible;

a roller assembly supported by said frame, said roller assembly movable between an upper position and a lower position, said roller assembly cooperative with said plurality of tubes so as to apply compressive force to said plurality of tubes in the upper position and to release the compressive force in the lower position, said roller assembly being movable fora desired distance along a length of said plurality of tubes, said roller assembly adapted to urge a liquid out of a lower end of said plurality of tubes by applying the compressive force to the plurality of tubes at the upper position and moving the roller assembly downwardly along said plurality of tubes while the compressive force is applied to said plurality of tubes, said roller assembly comprising a plurality of roller assemblies respectively cooperative with said plurality of tubes, each of said plurality of roller assemblies comprising:

a housing;

a first roller on one side of a tube of said plurality of tubes;

a second roller on an opposite side of the tube of said plurality of tubes; and an actuator cooperative with at least one of said first and second rollers, said actuator moving said first and second rollers relative to each other so as to move toward each other so as to apply the compressive force to the tube and to move away from each other so as to release the compressive force from the tube.

4. The liquid dispensing apparatus of claim 3, further comprising:

a panel supporting said plurality of roller assemblies in an identical relative position with respect to said plurality of tubes such that each of said plurality of roller assemblies is in in identical relative position as said roller assembly moves along said plurality of tubes.

5. The liquid dispensing apparatus of claim 3, further comprising:

a linear bearing connected to said roller assembly, said linear bearing being connected to said roller assembly so as to move said roller assembly upwardly and downwardly for the desired distance.

6. The liquid dispensing apparatus of claim 5, said linear bearing comprising a double-acting pneumatic actuator affixed to said frame, said double-acting pneumatic actuator extending in generally parallel relation to said plurality of tubes.

7. The liquid dispensing apparatus of claim 1, said plurality of tubes each comprising a flexible plastic tube having an upper end and a lower end supported by said frame, said plurality of tubes having the lower end extending outwardly of a bottom of said frame.

8. The liquid dispensing apparatus of claim 7, further comprising:

a plurality of nipples respectively affixed to the lower end of said plurality of tubes, said plurality of nipples adapted to allow the liquid to be released therefrom and to be directed downwardly.

9. The liquid dispensing apparatus of claim 1, further comprising:

a supply of the liquid;

a conduit extending from the supply of the liquid to said manifold; and a pump cooperative with said supply of liquid so as to urge the liquid through said conduit and into said manifold.

10. The liquid dispensing apparatus of claim 9, the liquid being a multi-part fluid, the supply of the liquid comprising:

a first container containing one part of the multi-part fluid; and a second container containing another part of the multi-part fluid.

11. The liquid dispensing apparatus of claim 10, further comprising:

a static mixer connected to said conduit so as to receive the parts of the multi-part fluid from said first and second containers and to mix the parts together, said conduit extending from said static mixer to said manifold.

12. The liquid dispensing apparatus of claim 9, said supply of the liquid being a supply of an epoxy or a polyurethane.

* * * * *